US009139358B2

(12) United States Patent
Levitan

(10) Patent No.: US 9,139,358 B2
(45) Date of Patent: Sep. 22, 2015

(54) DISPLAY CASE ASSEMBLY FOR PHONOGRAPH RECORD AND COVER

(71) Applicant: Richard Levitan, Potomac, MD (US)

(72) Inventor: Richard Levitan, Potomac, MD (US)

( * ) Notice: Subject to any disclaimer, the term of this patent is extended or adjusted under 35 U.S.C. 154(b) by 84 days.

(21) Appl. No.: 13/968,543

(22) Filed: Aug. 16, 2013

(65) Prior Publication Data

US 2015/0047996 A1 Feb. 19, 2015

(51) Int. Cl.
*B65D 85/00* (2006.01)
*B65D 85/57* (2006.01)
*A47G 1/16* (2006.01)

(52) U.S. Cl.
CPC ..... *B65D 85/544* (2013.01); *A47G 1/162* (2013.01)

(58) Field of Classification Search
CPC ..... A47G 1/162; A47G 1/06; A47G 1/12; A47G 2001/0688; Y10S 206/806; B65D 85/544
USPC ..... 206/311, 308.1, 232, 806, 309, 312, 206/313; 220/481, 848, 480, 845
See application file for complete search history.

(56) References Cited

U.S. PATENT DOCUMENTS

D117,584 S * 11/1939 Sova ..... D6/309
2,505,787 A * 5/1950 Munkacsi et al. ..... 40/340
3,107,783 A * 10/1963 Corey et al. ..... 206/310
D244,158 S * 5/1977 Averill ..... D6/300
4,030,138 A * 6/1977 Hillier ..... 360/135
4,124,118 A * 11/1978 Helm ..... 206/310
4,424,637 A * 1/1984 Leahy ..... 40/773
4,499,994 A * 2/1985 Rentch ..... 206/310
4,590,696 A * 5/1986 Squitieri ..... 40/792
4,623,062 A * 11/1986 Chase et al. ..... 206/45.28
D288,630 S * 3/1987 Haugen ..... D6/300
4,760,914 A * 8/1988 Gelardi et al. ..... 206/308.2
4,763,428 A * 8/1988 Fischer ..... 40/712
4,771,888 A * 9/1988 Lundeen ..... 206/387.11
4,895,252 A * 1/1990 Nomula et al. ..... 206/308.1
D308,350 S * 6/1990 England ..... D11/132
5,050,324 A * 9/1991 Casull ..... 40/767
5,253,753 A * 10/1993 Brownfield ..... 206/310
5,265,357 A * 11/1993 Yu ..... 40/714
D365,299 S * 12/1995 Berducat ..... D11/132
5,533,614 A * 7/1996 Walker ..... 206/308.1
D381,211 S * 7/1997 Aries et al. ..... D6/300
5,775,492 A * 7/1998 Ban ..... 206/308.1
6,070,721 A * 6/2000 Levitan ..... 206/308.1
6,604,635 B1 * 8/2003 Kutaragi et al. ..... 206/579
D615,320 S * 5/2010 Griffin et al. ..... D6/407
8,667,721 B2 * 3/2014 Heeps ..... 40/779
D702,245 S * 4/2014 Susman ..... D14/453

* cited by examiner

*Primary Examiner* — Anthony Stashick
*Assistant Examiner* — Ernesto Grano
(74) *Attorney, Agent, or Firm* — Berenato & White, LLC

(57) ABSTRACT

A display case assembly provided for simultaneously displaying a phonograph record cover and a phonograph record. The display case assembly comprises a base member having a planar bottom panel and a wall member extending upwardly from the bottom panel at an edge thereof, a mounting post projecting from the bottom panel for mounting the phonograph record thereon, a generally planar and transparent cover panel mounted on the wall member of the base member, and an edge trim member clamping together the cover panel and the base member at the edge of the bottom panel along a perimeter of the bottom panel. The shallow tray is dimensioned to receive the phonograph record cover to display therein between the wall member and the mounting post. The cover panel is made of a transparent material and dimensioned to overlay and cover an open top of the base member.

20 Claims, 18 Drawing Sheets

DISPLAY CASE ASSEMBLY FOR PHONOGRAPH RECORD AND COVER

BACKGROUND OF THE INVENTION

1. Field of the Invention

The present invention relates to display cases for records in general and, more particularly, to a display case assembly for simultaneously displaying both a phonograph record cover and a phonograph record associated with the record cover.

2. Description of the Related Art

Display frames or cases for phonograph record covers and for phonograph records are known and are used to display these items both by commercial music outlets or stores and by record owners. Such display cases or frames make an attractive wall display and are frequently used both as a room decoration and to openly display albums of a particular artist, or collector albums which are difficult to obtain. The known display frames or cases have been designed primarily for the display of the phonograph record cover, per se, although some frames are intended to provide a display and cover for the phonograph record. For example, U.S. Pat. No. 5,050,324 discloses a rigid square or rectangular frame structure in which one side of the frame may be displaced, against resilient spring force, to provide access to an album supported in the frame. The moveable frame member guide and supporting elements, and the coil spring retention mechanism are inherently bulky, difficult to operate, and expensive to manufacture. Also, the retention mechanism puts pressure on the album cover which can leave indentations in the cover.

The known phonograph record and album display devices generally are not provided for the simultaneous display of both the album cover and record. Therefore, conventional display cases with phonograph album covers are susceptible to improvements. With this in mind, a need exists to develop a display case assembly for simultaneously displaying both a phonograph record cover and phonograph record that advances the art.

SUMMARY OF THE INVENTION

The present invention is directed to a display case assembly for simultaneously displaying a phonograph record cover and phonograph record. The display case assembly according to the present invention comprises a base member in the form of an open top shallow tray having a planar bottom panel and a wall member defining the shallow tray. The bottom panel has an inner surface and an outer surface opposite the inner surface. The wall member extends upwardly from the inner surface of the bottom panel at an edge thereof along a perimeter of the bottom panel. The display case assembly further comprises a record mounting post formed on and projecting from the inner surface of the bottom panel for mounting the phonograph record on the bottom panel adjacent the wall member, a generally planar cover panel mounted on the wall member of the base member, and an edge trim member clamping together the cover panel and the base member at the edge of the bottom panel along the perimeter of the bottom panel. The shallow tray is dimensioned to receive the record cover to display therein between the wall member and the mounting post. The mounting post is dimensioned to project through a central opening in the phonograph record to locate the phonograph record in the display case assembly, just like a spindle of a standard record player. The cover panel is made of a transparent material and dimensioned to overlay and cover an open top of the base member.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DESCRIPTION OF EXEMPLARY EMBODIMENTS

Figure 1:
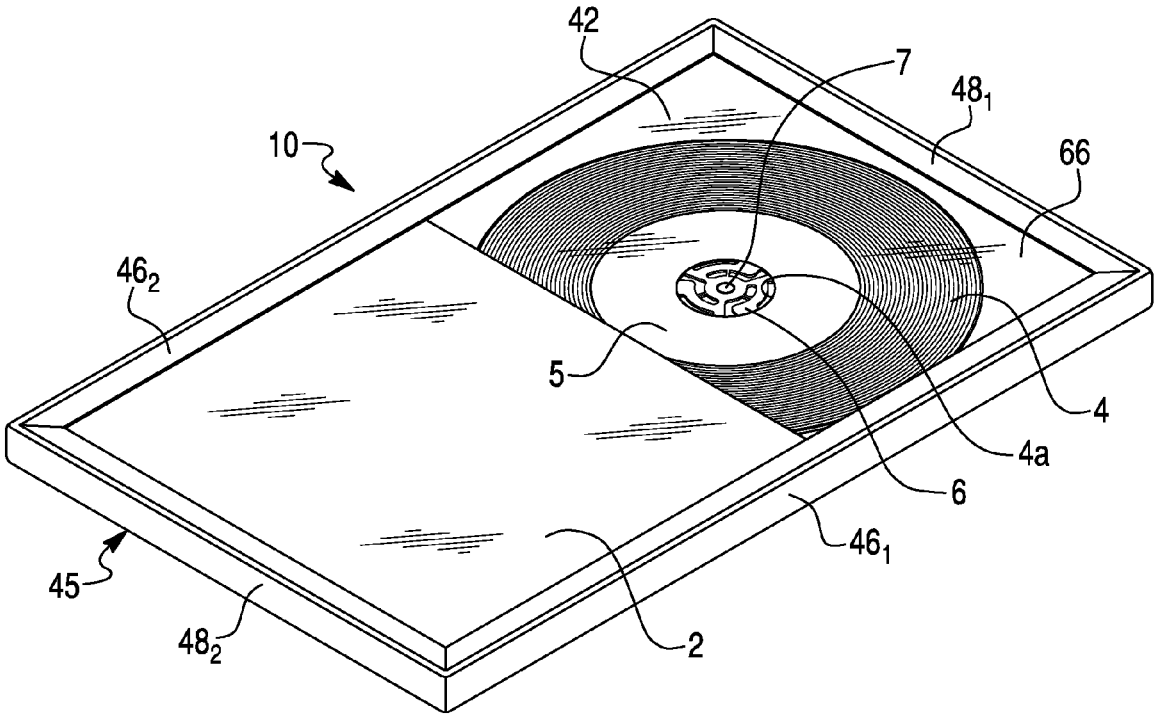
FIG. 1 is a perspective view of a display case assembly according to a first exemplary embodiment of the present invention, simultaneously displaying both a phonograph album and a 45 rpm single record associated with the album.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one" and the word "two" as used in the claims means "at least two".

Figure 2:
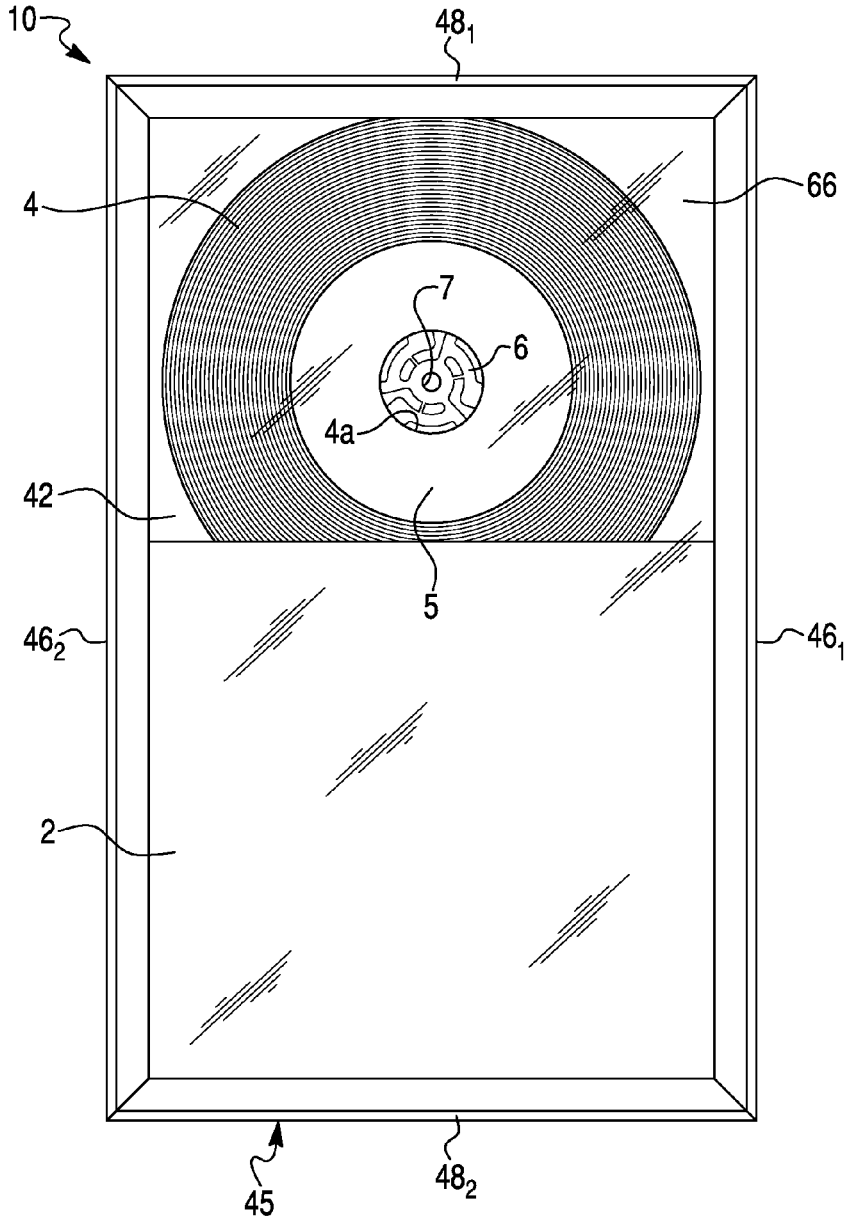
FIG. 2 is a front view of the display case assembly according to the first exemplary embodiment of the present invention.
Figure 3:
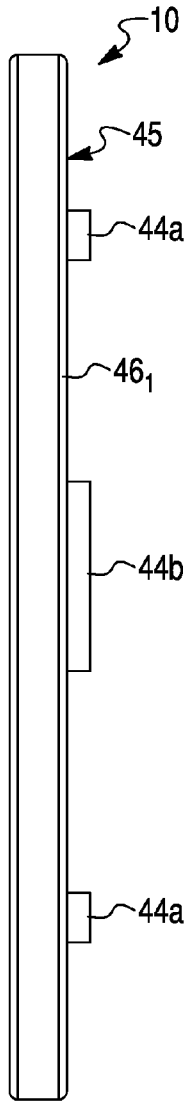
FIG. 3 is a side view of the display case according to the first exemplary embodiment of the present invention.

A first exemplary embodiment of the present invention is related to a display case assembly for simultaneously displaying both a phonograph record cover (or record sleeve) 2 and a phonograph record 4 associated with the record cover 2, generally denoted by reference numeral 10 shown in FIGS. 1-3. The display case assembly 10 according to the first exemplary embodiment of the present invention is intended primarily for 45 rpm single records (the names are derived from its play speed, 45 rpm). The 45 rpm single records, first released in 1949 by RCA Victor, have 7 inch (18 cm) in diameter with a large center hole and are made from vinyl plastic that is flexible and unbreakable in normal use.

Figure 4:
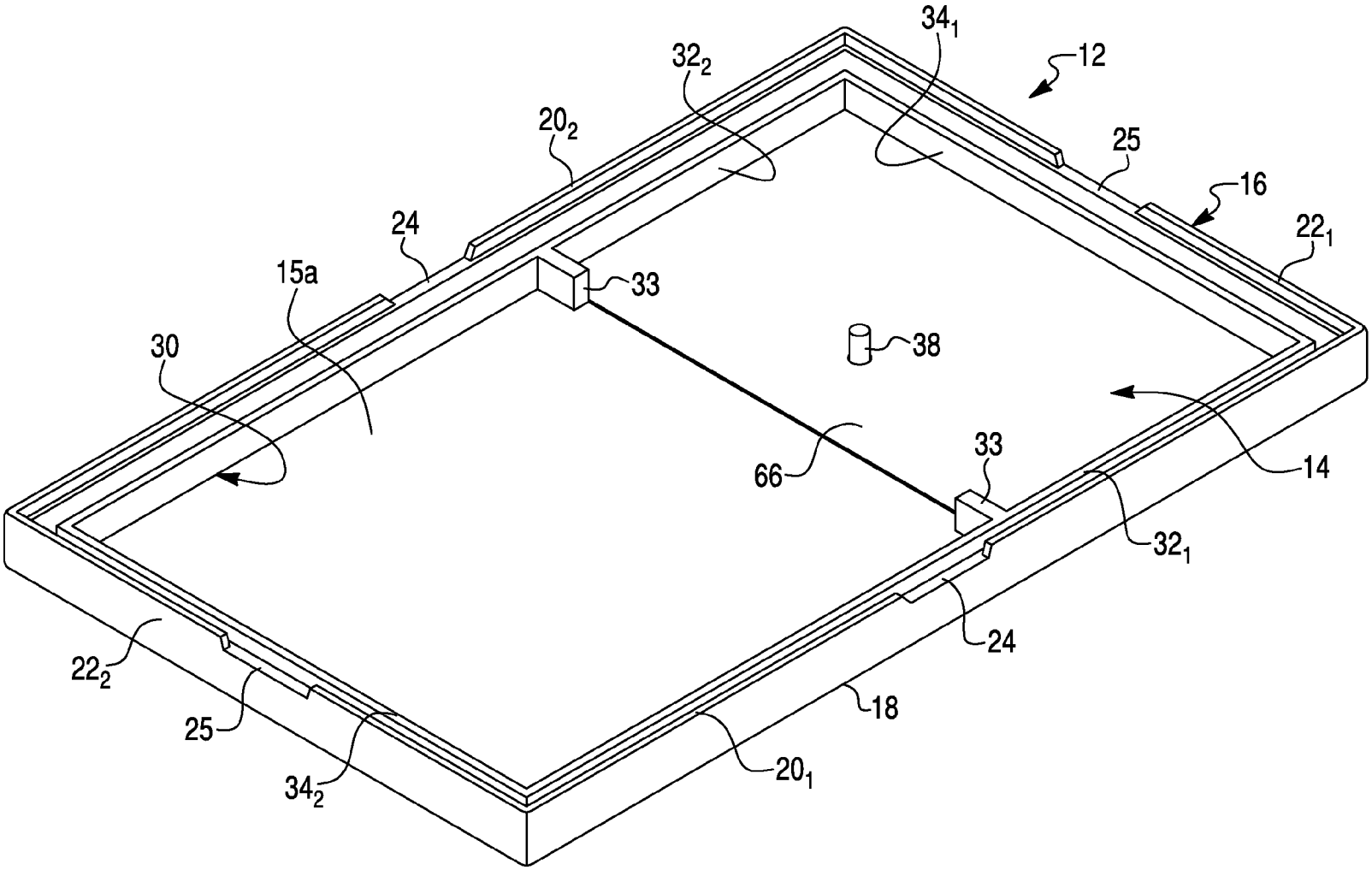
FIG. 4 is a perspective view of a base member of the display case assembly according to the first exemplary embodiment of the present invention.
Figure 5:
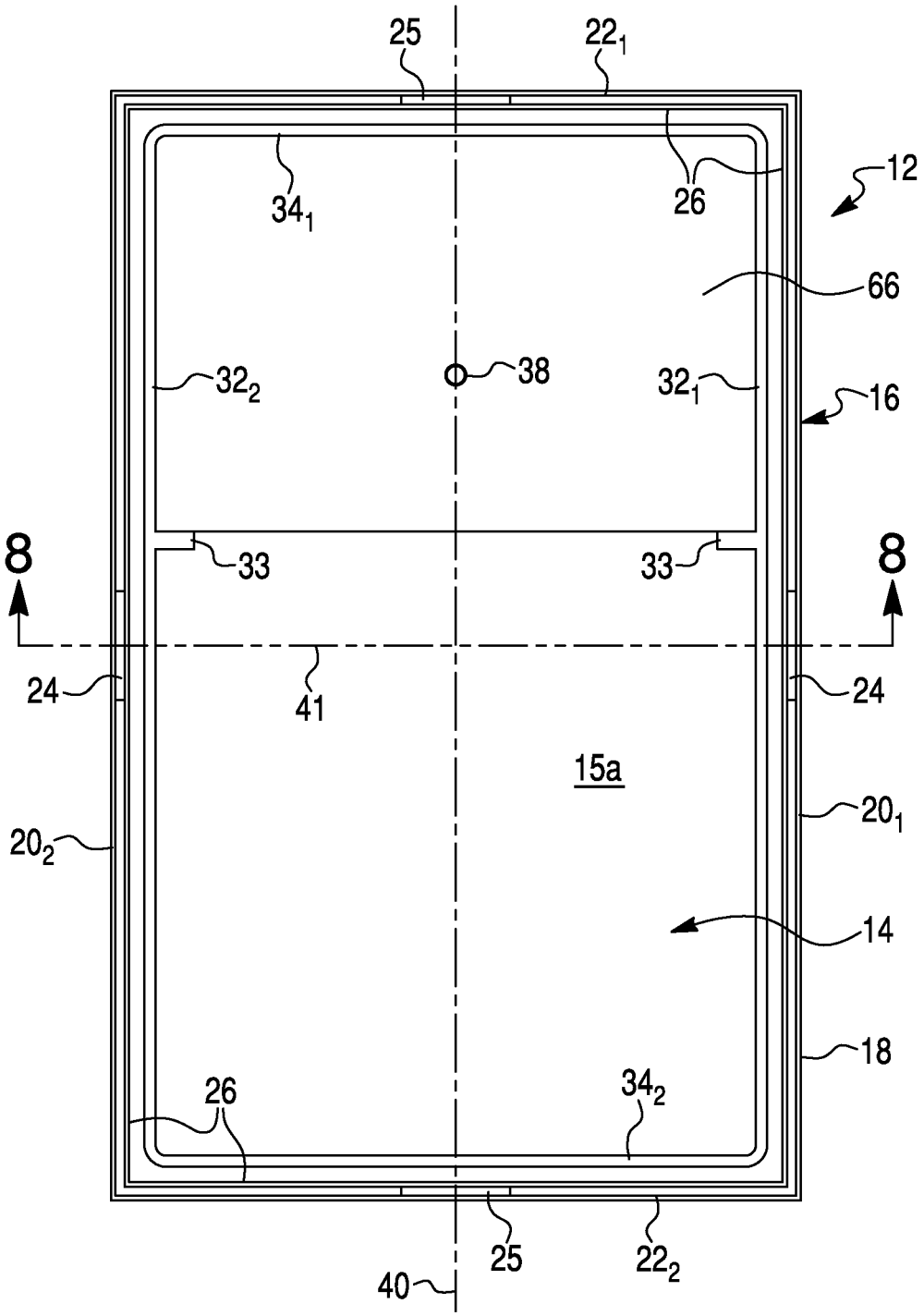
FIG. 5 is a front view of the base member according to the first exemplary embodiment of the present invention.

The display case assembly 10 comprises a base member 12 in the form of an open topped shallow tray including a substantially planar bottom panel 14 and a wall member 16 defining the shallow tray. The bottom panel 14 has an inner surface 15*a* and an outer surface 15*b* opposite the inner surface 15*a*. As illustrated in FIGS. 4-5, the wall member 16 extends upwardly from the inner surface 15*a* of the bottom panel 14 at an edge 18 thereof along a perimeter of the bottom panel 14 so as to form the shallow tray (or base member) 12 with an open top 17 best shown in FIGS. 8 and 9. According to the exemplary embodiment of the present invention, the base member 12 including the bottom panel 14 and the wall member 16 is integrally molded as a single-piece part from a single homogeneous mass of substantially rigid, transparent synthetic resin material such as a crystalline polystyrene material. Alternatively, the base member 12 may be formed from a different, substantially rigid material which is translucent or opaque and may be of any desired color, although the bottom panel 14 should be of a color which will contrast with the phonograph record 4.

The bottom panel 14 is substantially rectangular. Accordingly, the wall member 16 includes two opposite sidewalls $\mathbf{20}_1$ and $\mathbf{20}_2$ each extending along one long side edge of the rectangular bottom panel 14, and two opposite end walls $\mathbf{22}_1$ and $\mathbf{22}_2$ each extending along one short side edge of the rectangular bottom panel 14. In other words, the sidewalls $\mathbf{20}_1$ and $\mathbf{20}_2$ are longer than the end walls $\mathbf{22}_1$ and $\mathbf{22}_2$. A length of the base member 12, measured between the end walls $\mathbf{22}_1$ and $\mathbf{22}_2$ each, is greater than a width thereof by a distance at least slightly greater than a radius of a standard 45 rpm phonograph record 4, but preferably less than combined dimensions of the record cover 2 and a record diameter.

Figure 8:
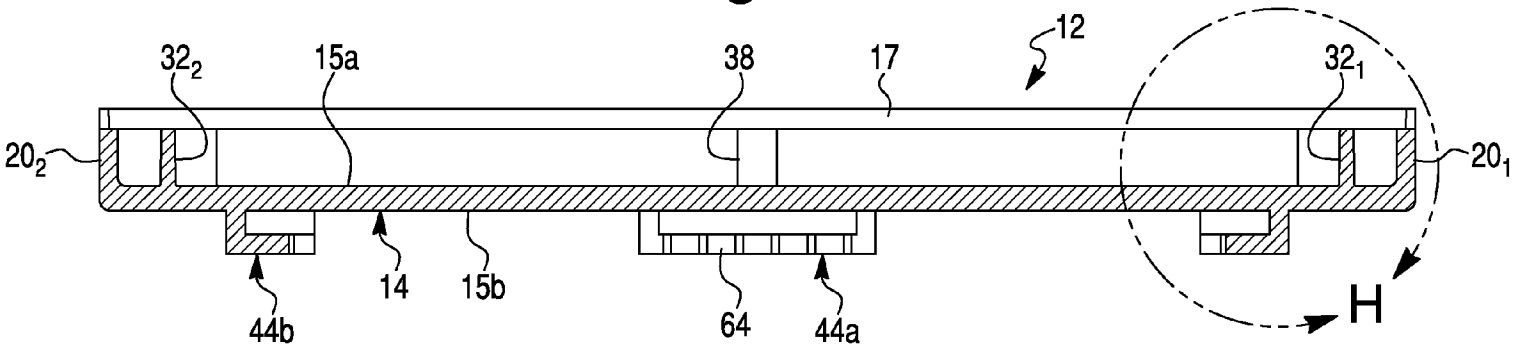
FIG. 8 is a cross-sectional view of the base member according to the first exemplary embodiment of the present invention taken along the lines 8-8 in FIG. 5.
Figure 9:
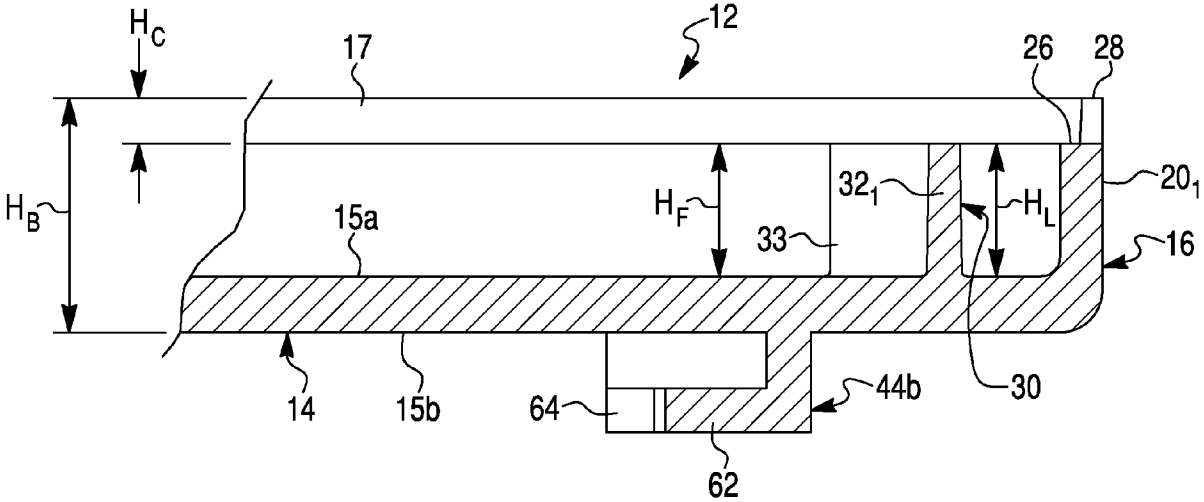
FIG. 9 is an enlarged view of a fragment of the base member shown in a circle "H" in FIG. 8.
Figure 10:
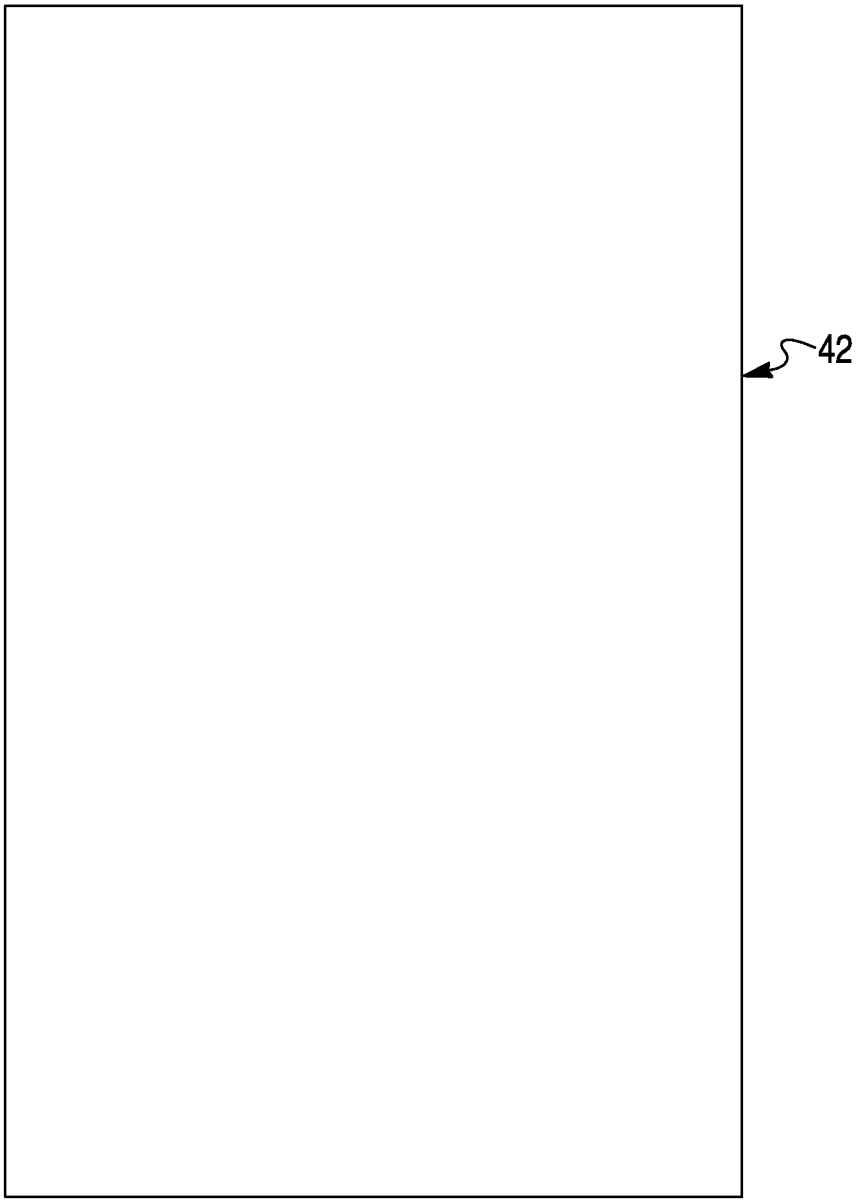
FIG. 10 is a front view of a cover panel of the display case assembly according to the first exemplary embodiment of the present invention.

As best shown in FIGS. 8 and 9, the wall member 16 is provided with an inwardly projecting ledge 26 at a location between the inner surface 15*a* of the bottom panel 14 and a distal end 28 of the wall member 16 shown in FIG. 9. In other words, each of the opposite sidewalls $\mathbf{20}_1$ and $\mathbf{20}_2$ and the opposite end walls $\mathbf{22}_1$ and $\mathbf{22}_2$ is provided with the ledge 26 so that the ledge 26 of the sidewall $\mathbf{20}_1$ faces the ledge 26 of the sidewall $\mathbf{20}_2$, and the ledge 26 of the end wall $\mathbf{22}_1$ faces the ledge 26 of the end wall $\mathbf{22}_2$.

Figure 7:
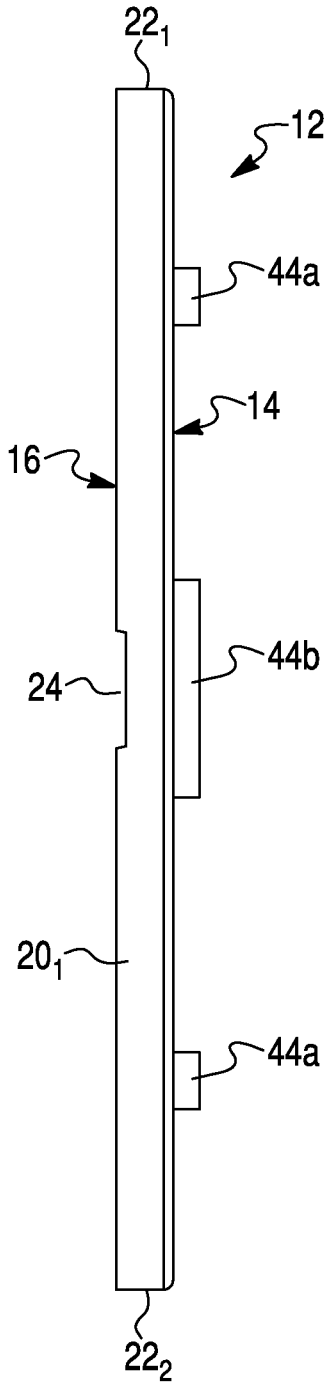
FIG. 7 is a side view of the base member according to the first exemplary embodiment of the present invention.

A notch 24 is formed at a central location in at least one, but preferably each of the sidewalls $\mathbf{20}_1$ and $\mathbf{20}_2$, as best shown in FIGS. 4, 5 and 7, to facilitate installation and/or removal of the phonograph record cover 2 in the base member 12. Similarly, another notch 25 is formed at a central location in at least one, but preferably each of the opposite end walls $\mathbf{22}_1$ and $\mathbf{22}_2$, as best shown in FIGS. 4 and 5, to facilitate installation and/or removal of the phonograph record cover 2 in the base member 12.

The base member 12 further includes a support flange member 30 disposed inside the wall member 16 as best shown in FIGS. 4, 5, 8 and 9. As illustrated, the support flange member 30 is spaced from the wall member 16 and extends upwardly from the inner surface 15*a* of the bottom panel 14 within a perimeter of the wall member 16. The support flange member 30 includes two opposite side flanges $\mathbf{32}_1$ and $\mathbf{32}_2$ each extending along one of the sidewalls $\mathbf{20}_1$ and $\mathbf{20}_2$, respectively, and two opposite end flanges $\mathbf{34}_1$ and $\mathbf{34}_2$ each extending along one of the end walls $\mathbf{22}_1$ and $\mathbf{22}_2$, respectively. In other words, the side flanges $\mathbf{32}_1$ and $\mathbf{32}_2$ are longer than the end flanges $\mathbf{34}_1$ and $\mathbf{34}_2$. As best shown in FIG. 9, a height $H_L$ of the ledge 26 substantially equals to a height $H_F$ of the support flange member 30.

The distance between the side flanges $\mathbf{32}_1$ and $\mathbf{32}_2$ is substantially equal to but slightly greater than the dimension of a standard phonograph record cover 2 of the 45 rpm record 4. A length of the base member 12, measured between the end flanges $\mathbf{34}_1$ and $\mathbf{34}_2$, is greater than the distance between the side flanges $\mathbf{32}_1$ and $\mathbf{32}_2$ by a distance at least slightly greater than a radius of a standard 45 rpm record 4, but preferably less than the combined dimensions of the record cover 2 and a diameter of the standard 45 rpm record 4.

The base member 12 further comprises a pair of opposite tabs 33 inwardly extending from the side flanges $\mathbf{32}_1$ and $\mathbf{32}_2$ so as to face each other. The distance between the tabs 33 and the end flange $\mathbf{34}_2$ is substantially equal to but slightly greater than the dimension of the standard record cover 2 of the standard 45 rpm record 4. In other words, when inserted in the base member of the display case assembly 10, the record cover 2 is disposed between the side flanges $\mathbf{32}_1$ and $\mathbf{32}_2$, and lengthwise between the tabs 33 and the lower end flange $\mathbf{34}_2$ so as to retain and prevent longitudinal movement of the record cover 2 within the base member 12 of the display case assembly 10 along the side flanges $\mathbf{32}_1$ and $\mathbf{32}_2$ in the direction of a longitudinal center line 40 of the base member 12. In the exemplary embodiment of the present invention, the tabs 33 are formed integrally as with the side flanges $\mathbf{32}_1$ and $\mathbf{32}_2$, and the bottom panel 14 of the base member 12 as a single-piece part such as by injection molding.

At the present time substantially all phonograph records play at either 45 or 33⅓ rpm. Standard LP (Long Play), or 33⅓ rpm, vinyl records normally employ a standard small diameter hole which fits precisely over a standard small spindle on a record player (turntable). The small diameter 45 rpm records 4 are provided with a comparatively large center hole 4*a* of 1½ inches in diameter (as shown in FIG. 1), while the standard LP records are provided with the standard small diameter hole, substantially smaller than 1½ inches. The small diameter 45 rpm records are primarily adapted to be played on a changer having a large spindle, and if they are played on a turntable having a standard small spindle, a 45 rpm spindle adapter 6 with a center hole 7, shown in FIG. 1, must be employed. The spindle adapter 6 is inserted into the large center hole 4*a* of the 45 rpm record 4 and effectively become part of the record. The spindle adapter 6 does not attach to the record 4 but merely provide the proper hole size for the 45 rpm record 4.

Conventionally, the 45 rpm spindle adapter 6 (also known as 45 rpm record insert) is a small plastic or metal insert that goes in the middle of a 45-rpm record so it will play on a turntable. The spindle adapter 6 could be a small solid circle that fits onto the bottom of the standard small spindle. The former RCA Corporation introduced a snap-in plastic spindle adapter known as a spider (such as the spindle adapter 5 shown in FIG. 1) to make 45 rpm records compatible with the smaller spindle size of a standard 33⅓ rpm LP record player. The spindle adapter 6 has an outer diameter substantially equal to the large center hole 4*a* of the 45 rpm record 4, and an inner diameter (the diameter of the center hole 7 thereof) substantially equal to the standard small diameter hole of the standard small spindle (or the standard small diameter hole of the standard 33⅓ rpm LP record.

The base member 12 further comprises a record-mounting post, or pin, 38 integrally molded on the inner surface 15*a* of the planar bottom panel 14. The record-mounting post 38 has an outside diameter dimensioned to fit within a central hole (or opening) of a standard LP (Long Play), or 33⅓ rpm, vinyl record. In other words, the post 38 has an outside diameter substantially equal to but slightly less than a standard small diameter hole of the standard LP record so as to accommodate the standard long playing (LP) 33⅓ rpm large diameter records. The post 38 is located on the longitudinal center line 40 of the bottom panel 14, i.e., midway between the sidewalls $\mathbf{20}_1$ and $\mathbf{20}_2$ and the side flanges $\mathbf{32}_1$ and $\mathbf{32}_2$, and spaced from the end flange $\mathbf{34}_1$ a distance substantially equal to one half the distance between the side flanges $\mathbf{32}_1$ and $\mathbf{32}_2$, which distance is slightly greater than the radius of the standard 45 rpm record 4.

Figure 11:
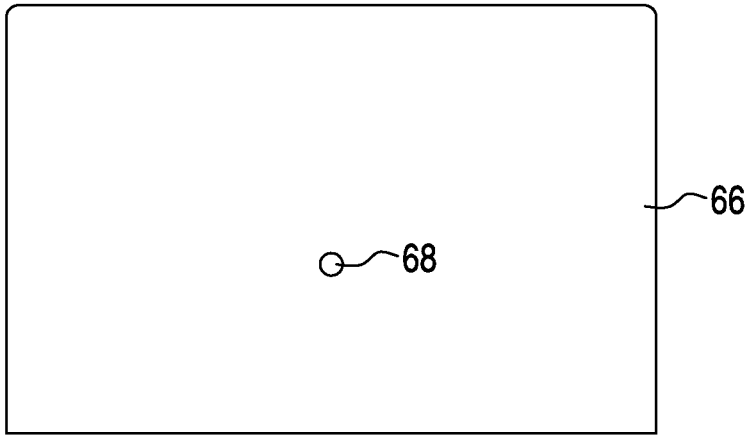
FIG. 11 is a front view of a background mat according to the exemplary embodiment of the present invention.

The display case assembly 10 further comprises a background mat 66 disposed in the base member 12. Specifically, the background mat 66 is placed on the bottom panel 14 and dimensioned so as to extend between the side flanges $\mathbf{32}_1$ and $\mathbf{32}_2$ in the direction of the longitudinal center line 40 and between the end flange $\mathbf{34}_1$ and the tabs 33 in the direction of a transverse center line 41. As best shown in FIG. 11, the background mat 66 is formed with a mounting hole 68 provided to receive the record-mounting post 38 theretrough. In the exemplary embodiment of the present invention, the background mat 66 is made of a paper. It will be appreciated that any other appropriate material, such as a sheet of plastic material, is within the scope of the present invention. At least one side of the background mat 66 facing the record 4 is colored in any appropriate color so as to provide a contrasting background to the record 4. In other words, the background mat 66 should be of a color which will contrast with the phonograph record 4.

Figure 6:
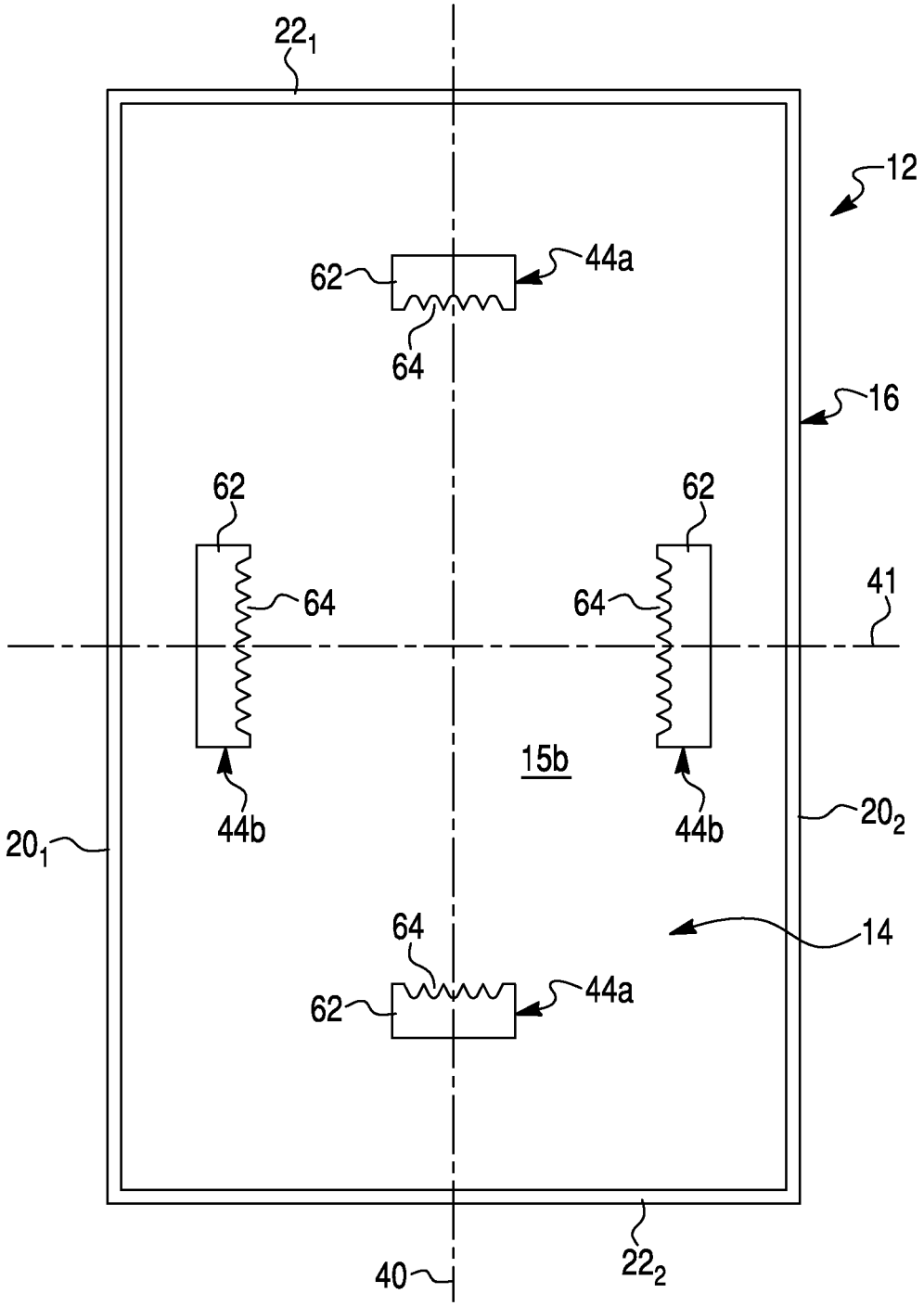
FIG. 6 is a rear view of the base member according to the first exemplary embodiment of the present invention.

Referring now to FIGS. 6-9, the outer surface 15*b* of the bottom panel 14 of the base member 12 is provided with a plurality of wall hanger elements for mounting the display case assembly 10 on a wall or other vertical surface with the longitudinal center line 40 of the display case assembly 10 either in the horizontal or vertical orientation. This is accomplished by a pair of identical short hanger bars 44*a* and a pair of identical long hanger bars 44*b*. As best illustrated in FIG. 6, the short hanger bars 44*a* are spaced from one another along the longitudinal center line 40, while the long hanger bars 44*b* are spaced from one another along a transverse center line 41. The long hanger bars 44*b* and the short hanger bars 44*a* are substantially geometrically and structurally identical and differ only by lengths thereof. Each of the hanger bars 44*a*, 44*b* is formed with a recess extending along a longitudinal side edge thereof to provide an overhanging ledge 62, and serrations 64 are formed in an edge of the overhanging ledge 62 for easily supporting the display case assembly 10 on a suitable fastener such as a tack or the head of a screw or nail.

According to the exemplary embodiment of the present invention, the bottom panel 14 of the base member 12 and the hanger bars 44*a*, 44*b* are integrally molded as a single-piece part from a single homogeneous mass of substantially rigid, transparent synthetic resin material such as a crystalline polystyrene material. Alternatively, the hanger bars 44*a*, 44*b* and the base member 12 may be formed from different, substantially rigid materials such that the hanger bars 44*a*, 44*b* are attached to the bottom panel 14 by any appropriate means known in the art. For example, an adhesive, screws, or the like may be employed to mount the hanger bars 44*a*, 44*b* directly to the bottom panel 14 of the base member 12.

The display case assembly 10 further comprises a generally planar cover panel 42 mounted on the wall member 16 and the support flange member 30 of the base member 12, and is dimensioned to overlay and cover the open top 17 of the base member 12. More specifically, the cover panel 42 is mounted on and supported by the ledge 26 of the side walls $\mathbf{20}_1$ and $\mathbf{20}_2$ and the end walls $\mathbf{22}_1$ and $\mathbf{22}_2$. In other words, the planar cover panel 42 is mounted within the wall member 16 of the base member 12. The cover panel 42 is also mounted on and supported by distal ends of the side flanges $\mathbf{32}_1$ and $\mathbf{32}_2$ and the end flanges $\mathbf{34}_1$ and $\mathbf{34}_2$. A height of the post 38 is substantially equal to, but preferably slight less than a height $H_F$ of the side flanges $\mathbf{32}_1$ and $\mathbf{32}_2$ so that, when the cover panel 42 is in the closed position as shown in FIGS. 1-3, a distal end of the post 38 does not actually contact an inner surface of the cover panel 42. Thus, in the display case assembly 10 of the present invention, nothing touches (puts pressure on) the record cover 2 or the record 4. The cover panel 42 is formed from a transparent material including glass or synthetic resin material such as a crystalline polystyrene material. The cover panel 42 is provided for protecting the phonograph record cover 2 and the record 4 during display.

The notches 24 and 25 formed at the central locations of each of the opposite side walls $\mathbf{20}_1$ and $\mathbf{20}_2$ and end walls $\mathbf{22}_1$ and $\mathbf{22}_2$ are provided to facilitate installation and/or removal of the cover panel 42 to/from the wall member 16 and the support flange member 30 of the base member 12.

A thickness of the cover panel 42 substantially equals to a distance $H_C$ between the ledge 26 and the distal end 28 of the wall member 16 shown in FIG. 9. Therefore, in an assembled condition of the display case assembly 10 when the cover panel 42 is mounted on and supported by the ledge 26 and the support flange member 30 of the base member 12, an outer surface of the cover panel 42 is generally flush with the distal end 28 of the wall member 16. Moreover, a combined thickness of the phonograph record cover 2 and the phonograph record 4 is substantially equal to or slightly less than the height $H_L$ of the ledge 26 of the wall member 16, shown in FIG. 9. Therefore, in an assembled condition of the display case assembly 10, the phonograph record cover 2 and the phonograph record 4 are disposed within (or inside of) the support flange member 30 of the base member 12 so that the phonograph record cover 2 and the phonograph record 4 do not extend above the ledge 26 and the distal end of the post 38. Consequently, when the cover panel 42 is mounted on and supported by the ledge 26 and the support flange member 30 of the wall member 16, the outer surface of the cover panel 42 is generally flush with the distal end 28 of the wall member 16.

The display case assembly 10 further comprises a trim (or fastening, clamping) member 45 provided for binding together the base member 12 and the cover panel 42. Specifically, the trim member 45 comprises two substantially identical long trim (or clamping) strips $\mathbf{46}_1$ and $\mathbf{46}_2$ extending longitudinally along the sidewalls $\mathbf{20}_1$ and $\mathbf{20}_2$, respectively, and two short trim strips $\mathbf{48}_1$ and $\mathbf{48}_2$ extending longitudinally along the end walls $\mathbf{22}_1$ and $\mathbf{22}_2$, respectively. The long trim strips $\mathbf{46}_1$ and $\mathbf{46}_2$ and the short trim strips $\mathbf{48}_1$ and $\mathbf{48}_2$ can be is colored in any appropriate color, such as black, gold or silver.

Figure 12A:
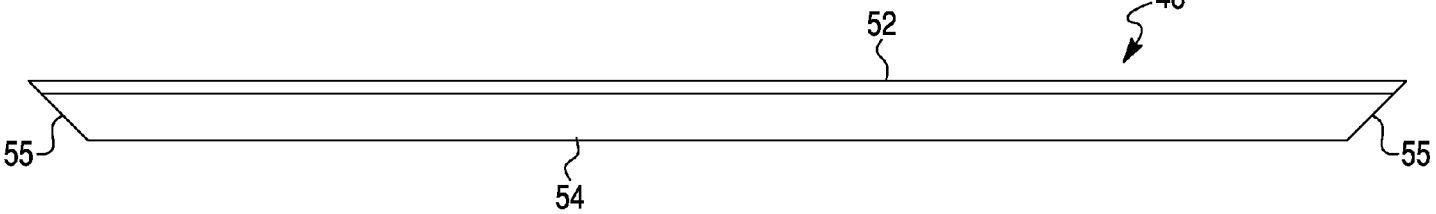
FIG. 12A is a side view of a long clampingstrip according to the first exemplary embodiment of the present invention.
Figure 12B:
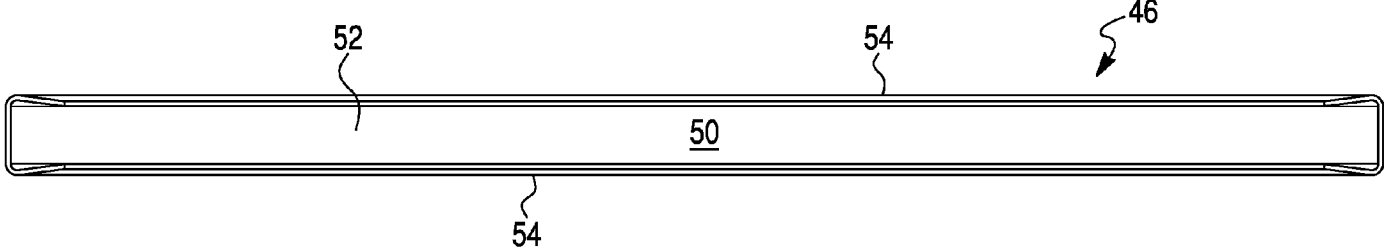
FIG. 12B is a bottom view of the long clampingstrip according to the first exemplary embodiment of the present invention.
Figure 12C:
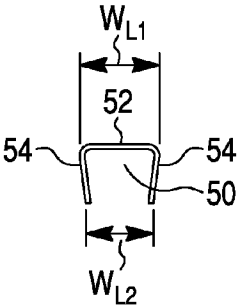
FIG. 12C is a cross-sectional view of the long clampingstrip according to the first exemplary embodiment of the present invention.
Figure 13A:
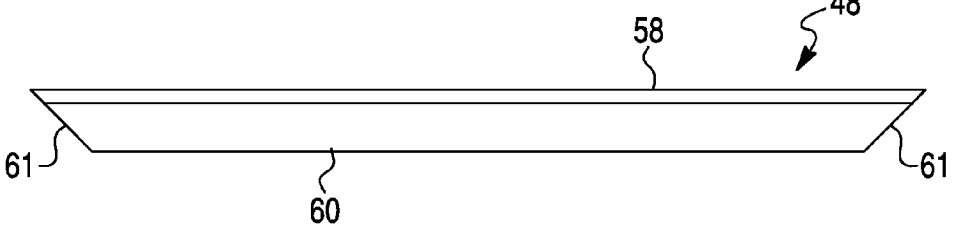
FIG. 13A is a side view of a short clampingstrip according to the first exemplary embodiment of the present invention.
Figure 13B:
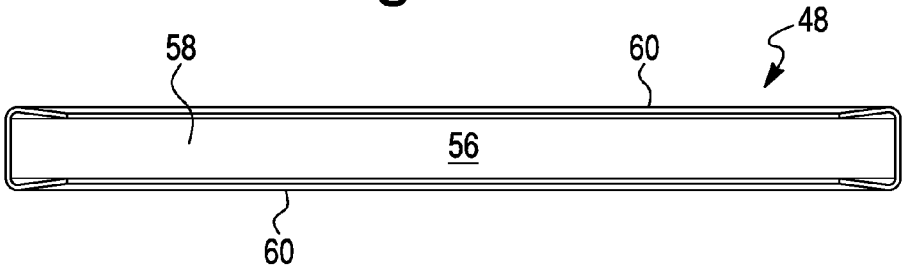
FIG. 13B is a bottom view of the short clampingstrip according to the first exemplary embodiment of the present invention.
Figure 13C:
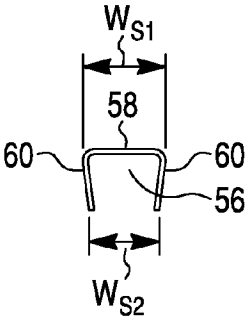
FIG. 13C is a cross-sectional view of the short clampingstrip according to the first exemplary embodiment of the present invention.

The long trim strips $\mathbf{46}_1$ and $\mathbf{46}_2$ are substantially structurally identical in this embodiment. In view of the structural similarities of the long trim strips $\mathbf{46}_1$ and $\mathbf{46}_2$, and in the interest of simplicity, the long trim strips $\mathbf{46}_1$ and $\mathbf{46}_2$ are depicted in FIGS. 12A, 12B and 12C using a reference numeral without a letter to designate both of the substantially identical long trim strips. For example, the reference numeral 46 is used when generically referring to the long trim strips $\mathbf{46}_1$ and $\mathbf{46}_2$ rather than reciting all two reference numerals. Similarly, the short trim (or clamping) strips $\mathbf{48}_1$ and $\mathbf{48}_2$ are substantially structurally identical in this embodiment. In view of the structural similarities of the short trim strips $\mathbf{48}_1$ and $\mathbf{48}_2$, and in the interest of simplicity, the short trim strips $\mathbf{48}_1$ and $\mathbf{48}_2$ are depicted in FIGS. 13A, 13B and 13C using a reference numeral without a letter to designate both of the substantially identical long trim strips. For example, the reference numeral 48 is used when generically referring to the short trim strips $\mathbf{48}_1$ and $\mathbf{48}_2$ rather than reciting all two reference numerals.

The long trim strip 46 and the short trim strip 48 have substantially geometrically and structurally identical and differ only by lengths thereof. Specifically, a length of the long trim strip 46 is bigger a length of the short trim strip 48. Moreover, the long trim strip 46 shown in detail in FIGS. 12A, 12B and 12C, has a substantially C-shaped configuration so as to define a channel 50 formed of a base wall 52 and two side walls 54 extending from the base wall 52. Similarly, the short trim strip 48 shown in detail in FIGS. 13A, 13B and 13C, has a substantially C-shaped configuration so as to define a channel 56 formed of a base wall 58 and two side walls 60 extending from the base wall 58.

In the exemplary embodiment of the present invention, the long and short clamping strips 46, 48 are formed of extruded plastic material. As illustrated in FIGS. 12A and 13A, each of distal ends of the extruded clamping strips 46 and 48 is cut to 45° to form a connection face 55 and 61, respectively. In an assembled condition, the connection face 55 of the long clamping strip 46 touches the connection face 61 of the short clamping strip 48 so as to form a 90° connection between the long and short clamping strips 46 and 48. The extruded clamping strips 46 and 48 are cut so that the outer dimensions of the base member 12 are substantially equal to the inner dimensions of the clamping strips 46 and 48. Thus, there is frictional engagement between the base member 12 with the cover panel 42 and the clamping strips 46, 48 provided by the pressure, exerted due to the elasticity of the clamping strips 46 and 48, so that one does not readily drop out of the other.

As further illustrated in FIGS. 12C and 13C, a width $W_{L1}$ of the base wall 52 of the long trim strip 46 is larger than a distance $W_{L2}$ between distal ends of the side walls 54 thereof in an unassembled position, while a width $W_{S1}$ of the base wall 58 of the short trim strip 48 is larger than a distance $W_{S2}$ between distal ends of the side walls 60 thereof in the unassembled position. In other words, the both side walls 54, 60 of the trim strips 46, 48 incline toward each other. Specifically, one of the side walls 54, 60 of the trim strips 46, 48 is inclined toward an outer surface of the cover panel 42 and engages it with the distal end thereof, while another side wall 54, 60 is inclined toward the outer surface 15*b* of the bottom panel 14 of the base member 12 and engages it with the distal end thereof. Moreover, the distance $W_{L2}$, $W_{S2}$ between distal ends of the side walls 54, 60 of the clamping strip 46, 48 is less than a thickness $H_B$ of the base member 12 with the cover panel 42, which is flush with the distal end 28 of the wall member 16.

The long and short trim strips 46 and 48 are made of a resilient material, preferably plastic, e.g., polyvinylchloride. Thus, the distal ends of the side walls 54, 60 of the long and short clamping strips 46 and 48 can spread apart to insert the base member 12 with the cover panel 42 into the channel 50, 56 between the side walls 54, 60. Accordingly, the distance between the distal ends of the side walls 54, 60 of the long and short trim strips 46 and 48 can change due to the resiliency of the material of the clamping strips 46 and 48. The long trim strip 46 and the short trim strip 48 do not require structural strength, since they engage and are supported by the rigid base member 12. Therefore, relatively flexible plastic material, for example, may be used to form the long and short trim strips 46 and 48.

Therefore, in an assembled condition of the display case assembly 10 when the cover panel 42 is mounted on and supported by the ledge 26 of the wall member 16, the clamping strips 46 and 48, whose elasticity exerts pressure to bind together the base member 12 and the cover panel 42, forces the bent side walls 54, 60 of the long and short clamping strips 46, 48 against the cover panel 42 and the outer surface 15*b* of the bottom panel 14 of the base member 12 to clamp them tightly together. Consequently, the transparent cover panel 42 and the base member 12 are pressed together by the clamping strips 46, 48, due to the resiliency of the material employed, with the result that the record cover 2 and the phonograph record 4 are displayed, enclosed in between them.

As shown in FIGS. 1 and 2, both the record cover 2 and the 45 rpm phonograph record 4 are displayed within the display case assembly 10 so that the record 4 is displayed in a position partially inserted into the record cover 2 and partially exposed for viewing through a transparent cover panel 42.

In order to place the record cover 2 and the 45 rpm phonograph record 4 into the display case assembly 10, the long and short clamping strips 46, 48 are detached from the shallow tray 12 and the cover panel 42 is removed from the wall member 16 of the shallow tray 12. Then, the 45 rpm phonograph record 4 is inserted into the open top 17 of the shallow tray 12 and placed over the background mat 66. The central opening 4*a* in the record 4 is positioned over the spindle adapter 5, which, in turn, is positioned over the record mounting pin 38. The mounting pin 38 is located from the end flange $\mathbf{34}_1$ a distance substantially equal to one-half the spacing between the side flanges $\mathbf{32}_1$ and $\mathbf{32}_2$ so that more than one-half and preferably most of a record label 5 is visible through the transparent cover panel 42 of the display case assembly 10. Next, the record cover 2 is positioned on the bottom panel 14 of the shallow tray 12 between the side flanges $\mathbf{32}_1$ and $\mathbf{32}_2$, and lengthwise between the tabs 33 and the lower end flange $\mathbf{34}_2$, and the cover panel 42 is placed on the ledge 26 on top of the record cover 2. Finally, the shallow tray 12 and the cover panel 42 are fastened together by the clamping strips 46, 48 due to the resiliency of the material employed, with the result that the record cover 2 and the phonograph record 4 are displayed, enclosed in between them. The clamping strips 46, 48 extend along the perimeter of the bottom panel 14 of the shallow tray 12.

FIGS. 14-22 illustrate a second exemplary embodiment of a display case assembly for simultaneously displaying both a phonograph record (or album) cover 102 and a phonograph record 104 associated with the album cover 102, generally depicted by the reference character 110. Components, which are unchanged from the first exemplary embodiment of the present invention, are labeled with the same reference characters. Components, which function in the same way as in the first exemplary embodiment of the present invention depicted in FIGS. 1-13C are designated by the same reference numerals to some of which 100 has been added, sometimes without being described in detail since similarities between the corresponding parts in the two embodiments will be readily perceived by the reader.

The display case assembly 110 according to the second exemplary embodiment of the present invention is intended primarily for a standard LP (Long Play), or 33⅓ rpm, microgroove vinyl record. The LP records, introduced by Columbia Records in 1948, have 12-inch (30 cm) in diameter with a center hole and are made from vinyl plastic that is flexible and unbreakable in normal use.

The display case assembly of FIGS. 14-16 corresponds substantially to the display case assembly of FIGS. 1-13C, and only portions of the display case assembly 110, which differ, will therefore be explained in detail below. The display case assembly 110 comprises a base member 112 in the form of an open topped shallow tray and a generally planar cover panel 42 mounted on the shallow tray 112, and is dimensioned to overlay and cover an open top 117 of the shallow tray 112. The base member 112 includes a substantially planar bottom panel 14 and a wall member 16 defining the shallow tray, and the generally planar cover panel 42 is mounted on the wall member 16 of the base member 112. The bottom panel 14 has an inner surface 15*a* and an outer surface 15*b* opposite the inner surface 15*a*. As illustrated in FIGS. 17, 18 and 20-22, the wall member 16 extends upwardly from the inner surface 15*a* of the bottom panel 14 at an edge 18 thereof along a perimeter of the bottom panel 14 so as to form the shallow tray (or base member) 112 with an open top 117 best shown in FIGS. 21 and 22. According to the exemplary embodiment of the present invention, the base member 112 including the bottom panel 14 and the wall member 16 is integrally molded as a single-piece part from a single homogeneous mass of substantially rigid, transparent synthetic resin material such as a crystalline polystyrene material. Alternatively, the base member 112 may be formed from a different, substantially rigid material which is translucent or opaque and may be of any desired color, although the bottom panel 14 should be of a color which will contrast with the LP record 104.

The bottom panel 14 is substantially rectangular. Accordingly, the wall member 16 includes two opposite sidewalls $\mathbf{20}_1$ and $\mathbf{20}_2$ each extending along one long side edge of the rectangular bottom panel 14, and two opposite end walls $\mathbf{22}_1$ and $\mathbf{22}_2$ each extending along one short side edge of the rectangular bottom panel 14. In other words, the sidewalls $\mathbf{20}_1$ and $\mathbf{20}_2$ are longer than the end walls $\mathbf{22}_1$ and $\mathbf{22}_2$. A length of the base member 112, measured between the end walls $\mathbf{22}_1$ and $\mathbf{22}_2$ each, is greater than a width thereof by a distance at least slightly greater than a radius of a standard LP phonograph record 104, but preferably less than combined dimensions of the album cover 102 and a record diameter.

Figure 21:
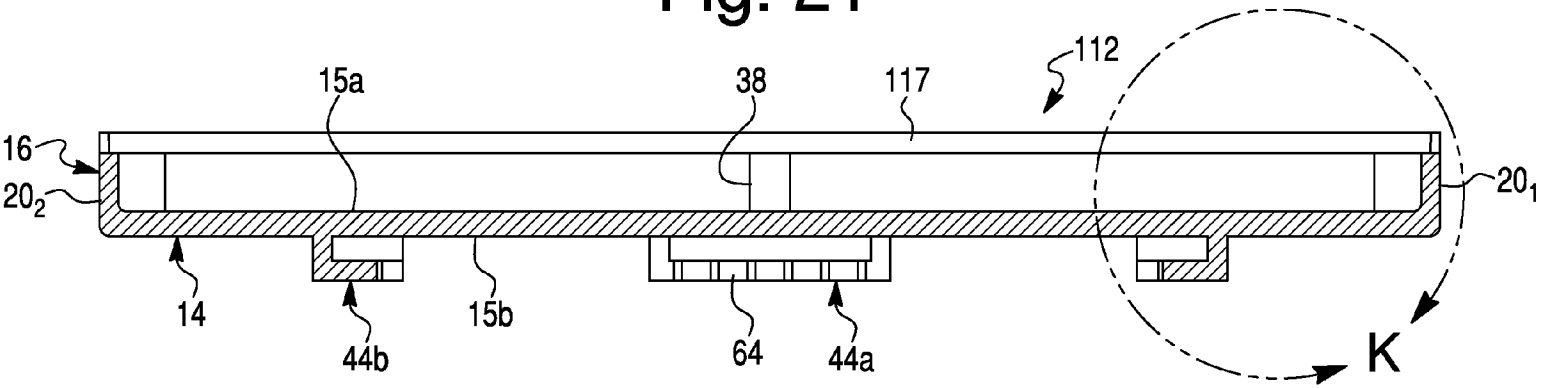
FIG. 21 is a cross-sectional view of the base member according to the first exemplary embodiment of the present invention taken along the lines 21-21 in FIG. 18.
Figure 22:
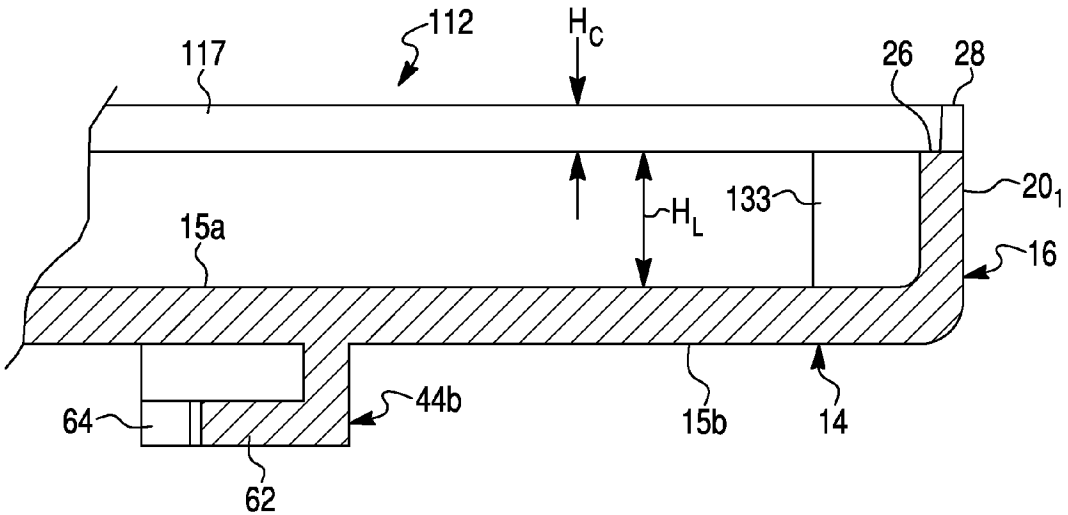
FIG. 22 is an enlarged view of a fragment of the base member shown in a circle "K" in FIG. 21.

As best shown in FIGS. 21 and 22, the wall member 16 is provided with an inwardly projecting ledge 26 at a location between the inner surface 15*a* of the bottom panel 14 and a distal end 28 of the wall member 16 shown in FIG. 22. In other words, each of the opposite sidewalls $\mathbf{20}_1$ and $\mathbf{20}_2$ and the opposite end walls $\mathbf{22}_1$ and $\mathbf{22}_2$ is provided with the ledge 26 so that the ledge 26 of the sidewall $\mathbf{20}_1$ faces the ledge 26 of the sidewall $\mathbf{20}_2$, and the ledge 26 of the end wall $\mathbf{22}_1$ faces the ledge 26 of the end wall $\mathbf{22}_2$.

The distance between the sidewalls $\mathbf{20}_1$ and $\mathbf{20}_2$ is substantially equal to but slightly greater than the dimension of a standard phonograph album cover 102 of the LP record 104. A length of the base member 112, measured between the end walls $\mathbf{22}_1$ and $\mathbf{22}_2$, is greater than the distance between the sidewalls $\mathbf{20}_1$ and $\mathbf{20}_2$ by a distance at least slightly greater than a radius of a standard LP record 104, but preferably less than the combined dimensions of the album cover 102 and a diameter of the standard LP record 104.

The base member 112 further comprises a pair of opposite tabs 133 inwardly extending from the side flanges $\mathbf{20}_1$ and $\mathbf{20}_2$ so as to face each other. The distance between the tabs 133 and the end flange $\mathbf{22}_2$ is substantially equal to but slightly greater than the dimension of the standard LP record cover 102 of the standard LP record 104. In other words, when inserted in the base member of the display case assembly 110, the LP record cover 102 is disposed between the side flanges $\mathbf{20}_1$ and $\mathbf{20}_2$, and lengthwise between the tabs 133 and the lower end flange $\mathbf{22}_2$ so as to retain and prevent longitudinal movement of the LP record cover 102 within the shallow tray 112 of the display case assembly 110 along the side flanges $\mathbf{20}_1$ and $\mathbf{20}_2$ in the direction of a longitudinal center line 40 of the base member 112. In the exemplary embodiment of the present invention, the tabs 133 are formed integrally as with the side flanges $\mathbf{20}_1$ and $\mathbf{20}_2$, and the bottom panel 14 of the base member 112 as a single-piece part such as by injection molding.

The base member 112 further comprises a record-mounting post, or pin, 38 integrally molded on the inner surface 15*a* of the planar bottom panel 14. The record-mounting post 38 has an outside diameter dimensioned to fit within a central opening of the standard LP record 104 to position and support the record 104 in the display case assembly 110. The post 38 is located on a longitudinal center line 40 of the bottom panel 14, i.e., midway between the sidewalls $\mathbf{20}_1$ and $\mathbf{20}_2$, and spaced from the end wall $\mathbf{22}_1$ a distance substantially equal to one half the distance between the sidewalls $\mathbf{20}_1$ and $\mathbf{20}_2$, which distance is slightly greater than the radius of the standard LP record 104.

The display case assembly 110 further comprises a background mat 66 disposed in the shallow tray 112. Specifically, the background mat 66 is placed on the bottom panel 14 and dimensioned so as to extend between the side flanges $\mathbf{20}_1$ and $\mathbf{20}_2$ in the direction of the longitudinal center line 40 and between the end flange $\mathbf{22}_1$ and the tabs 133 in the direction of a transverse center line 41. As best shown in FIG. 11, the background mat 66 is formed with a mounting hole 68 provided to receive the record-mounting post 38 theretrough. In the exemplary embodiment of the present invention, the background mat 66 is made of a paper. It will be appreciated that any other appropriate material, such as a sheet of plastic material, is within the scope of the present invention. At least one side of the background mat 66 facing the record 104 is colored in any appropriate color so as to provide a contrasting background to the record 104. In other words, the background mat 66 should be of a color which will contrast with the phonograph record 104.

The display case assembly 110 further comprises a generally planar cover panel 42 mounted on the wall member 16 of the base member 12, and is dimensioned to overlay and cover the open top 117 of the base member 112. More specifically, the cover panel 42 is mounted on and supported by the ledge 26 of the sidewalls $\mathbf{20}_1$ and $\mathbf{20}_2$ and the end walls $\mathbf{22}_1$ and $\mathbf{22}_2$. The height of the post 38 is substantially equal to, but preferably slight less than the height of the ledge 26 so that, when the cover panel 42 is in the closed position as shown in FIGS. 14-16, a distal end of the post 38 does not actually contact an inner surface of the cover panel 42. The cover panel 42 is formed from a transparent material including glass or synthetic resin material such as a crystalline polystyrene material. The notches 24 and 25 formed at the central locations of each of the opposite side walls $\mathbf{20}_1$ and $\mathbf{20}_2$ and end walls $\mathbf{22}_1$ and $\mathbf{22}_2$ are provided to facilitate installation and/or removal of the cover panel 42 to/from the wall member 16 of the base member 112.

A thickness of the cover panel 42 substantially equals to a distance $H_C$ between the ledge 26 and the distal end 28 of the wall member 16 shown in FIG. 22. Therefore, in an assembled condition of the display case assembly 110 when the cover panel 42 is mounted on and supported by the ledge 26 of the wall member 16 of the base member 112, an outer surface of the cover panel 42 is generally flush with the distal end 28 of the wall member 16. Moreover, a combined thickness of the phonograph record cover 102 and the phonograph record 104 is substantially equal to or slightly less than the height $H_L$ of the ledge 26 of the wall member 16, shown in FIG. 22. Therefore, in an assembled condition of the display case assembly 110, the phonograph record cover 102 and the phonograph record 104 are disposed within (or inside of) the wall member 16 of the base member 112 so that the phonograph record cover 102 and the phonograph record 104 do not extend above the ledge 26 and the distal end of the post 38. Consequently, when the cover panel 42 is mounted on and supported by the ledge 26 of the wall member 16, the outer surface of the cover panel 42 is generally flush with the distal end 28 of the wall member 16.

Similarly to the display case assembly 10 according to the first exemplary embodiment of the present invention, the display case assembly 110 further comprises a trim (or fastening, clamping) member 45 (best shown in FIGS. 12A-13C) provided for binding together the base member 112 and the cover panel 42. Specifically, the trim member 45 comprises two substantially identical long trim (or clamping) strips $\mathbf{46}_1$ and $\mathbf{46}_2$ extending longitudinally along the sidewalls $\mathbf{20}_1$ and $\mathbf{20}_2$, respectively, and two short trim strips $\mathbf{48}_1$ and $\mathbf{48}_2$ extending longitudinally along the end walls $\mathbf{22}_1$ and $\mathbf{22}_2$, respectively. In an assembled condition of the display case assembly 110 when the cover panel 42 is mounted on and supported by the ledge 26 of the wall member 16, the clamping strips 46 and 48, whose elasticity exerts pressure to bind together the base member 112 and the cover panel 42, forces the bent side walls 54, 60 of the long and short clamping strips 46, 48 against the cover panel 42 and the outer surface 15*b* of the bottom panel 14 of the base member 112 to clamp them tightly together. Consequently, the transparent cover panel 42 and the base member 112 are pressed together by the clamping strips 46, 48, due to the resiliency of the material employed, with the result that the album cover 102 and the phonograph record 104 are displayed, enclosed in between them.

Figure 14:
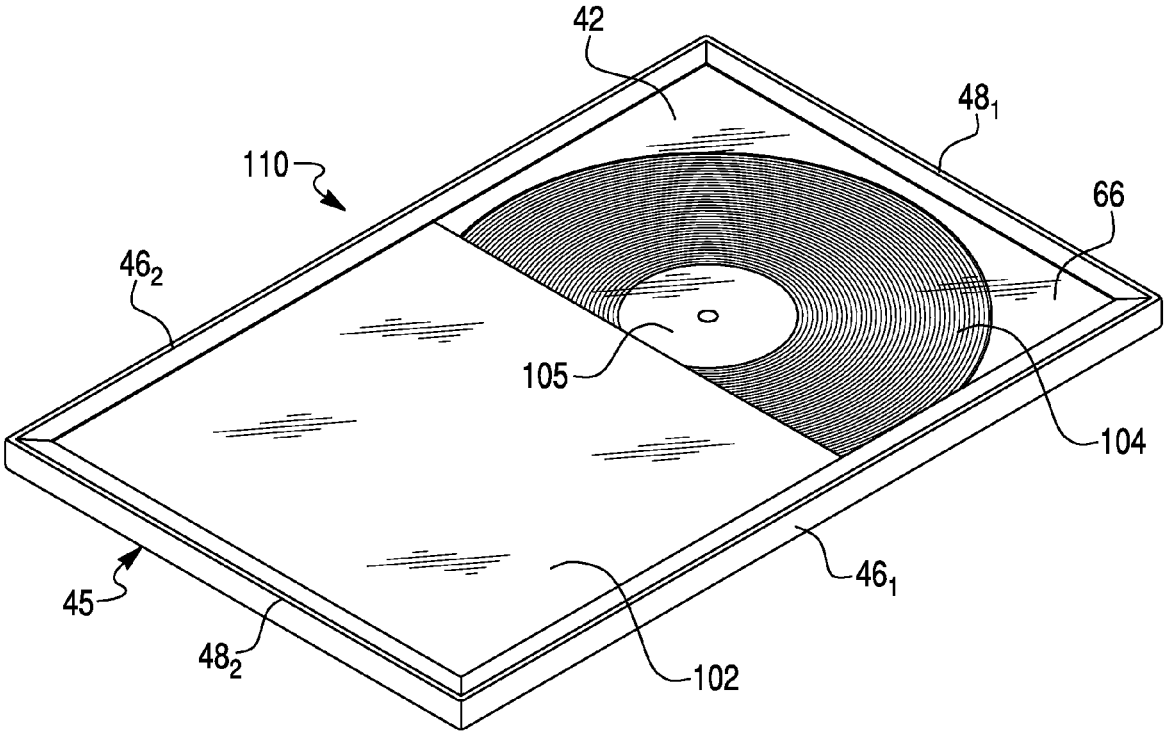
FIG. 14 is a perspective view of a display case assembly according to a second exemplary embodiment of the present invention, simultaneously displaying both a phonograph album and an LP record associated with the album.
Figure 15:
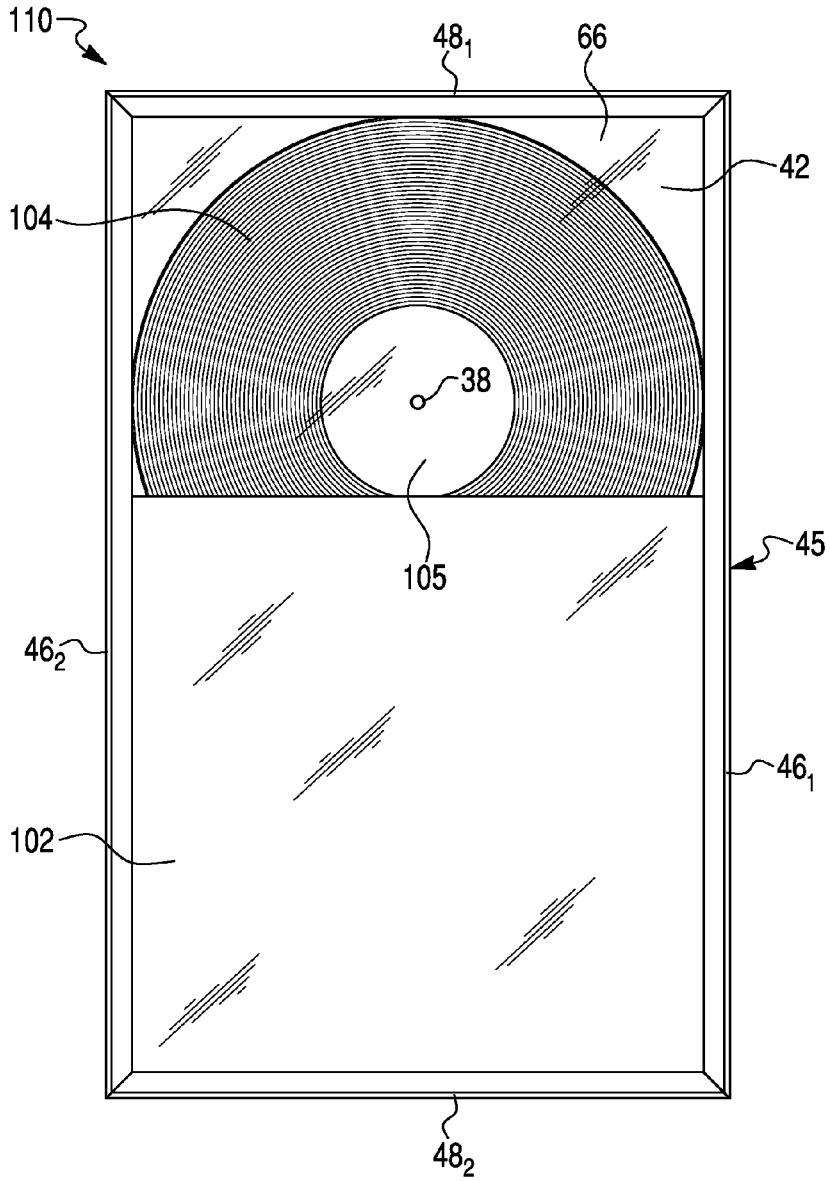
FIG. 15 is a front view of the display case assembly according to the second exemplary embodiment of the present invention.
Figure 16:
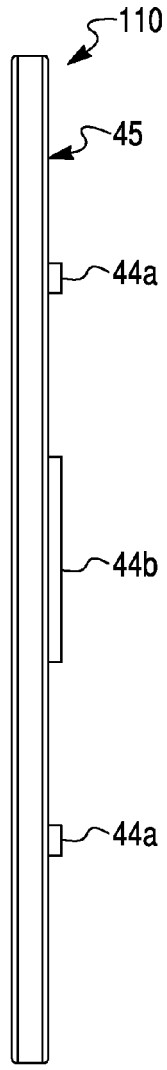
FIG. 16 is a side view of the display case according to the second exemplary embodiment of the present invention.
Figure 17:
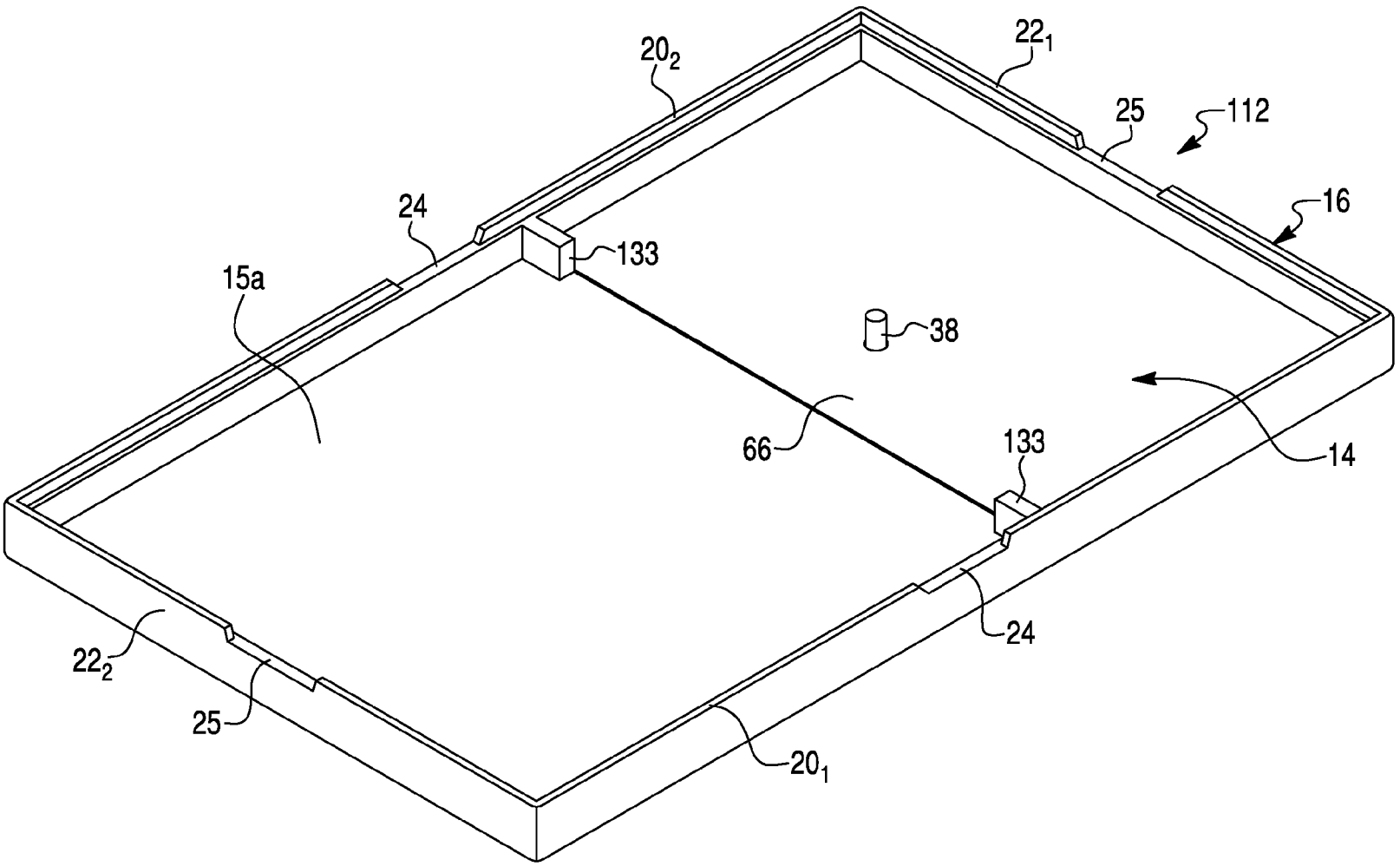
FIG. 17 is a perspective view of a base member of the display case assembly according to the second exemplary embodiment of the present invention.
Figure 18:
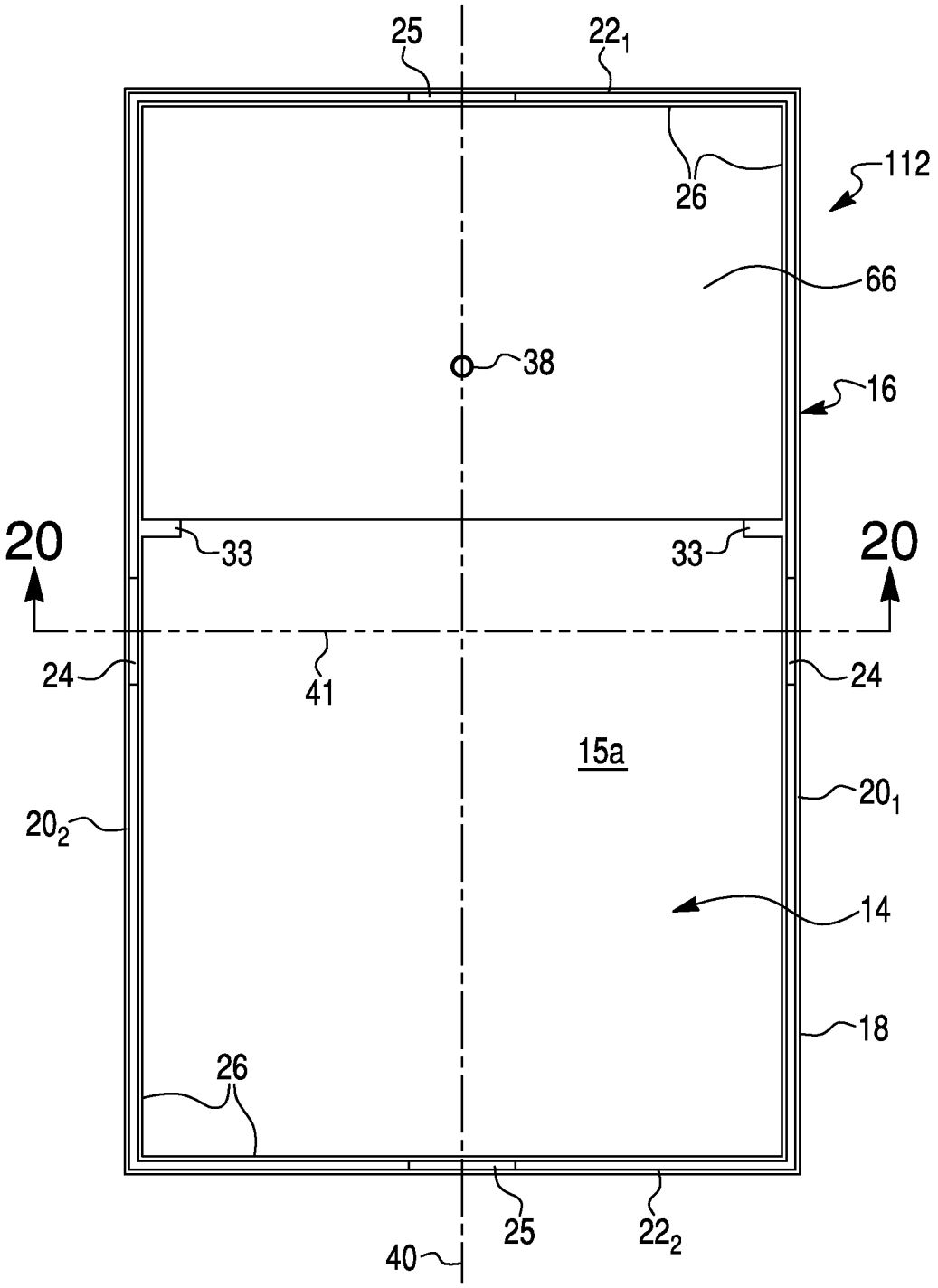
FIG. 18 is a front view of the base member according to the second exemplary embodiment of the present invention.
Figure 19:
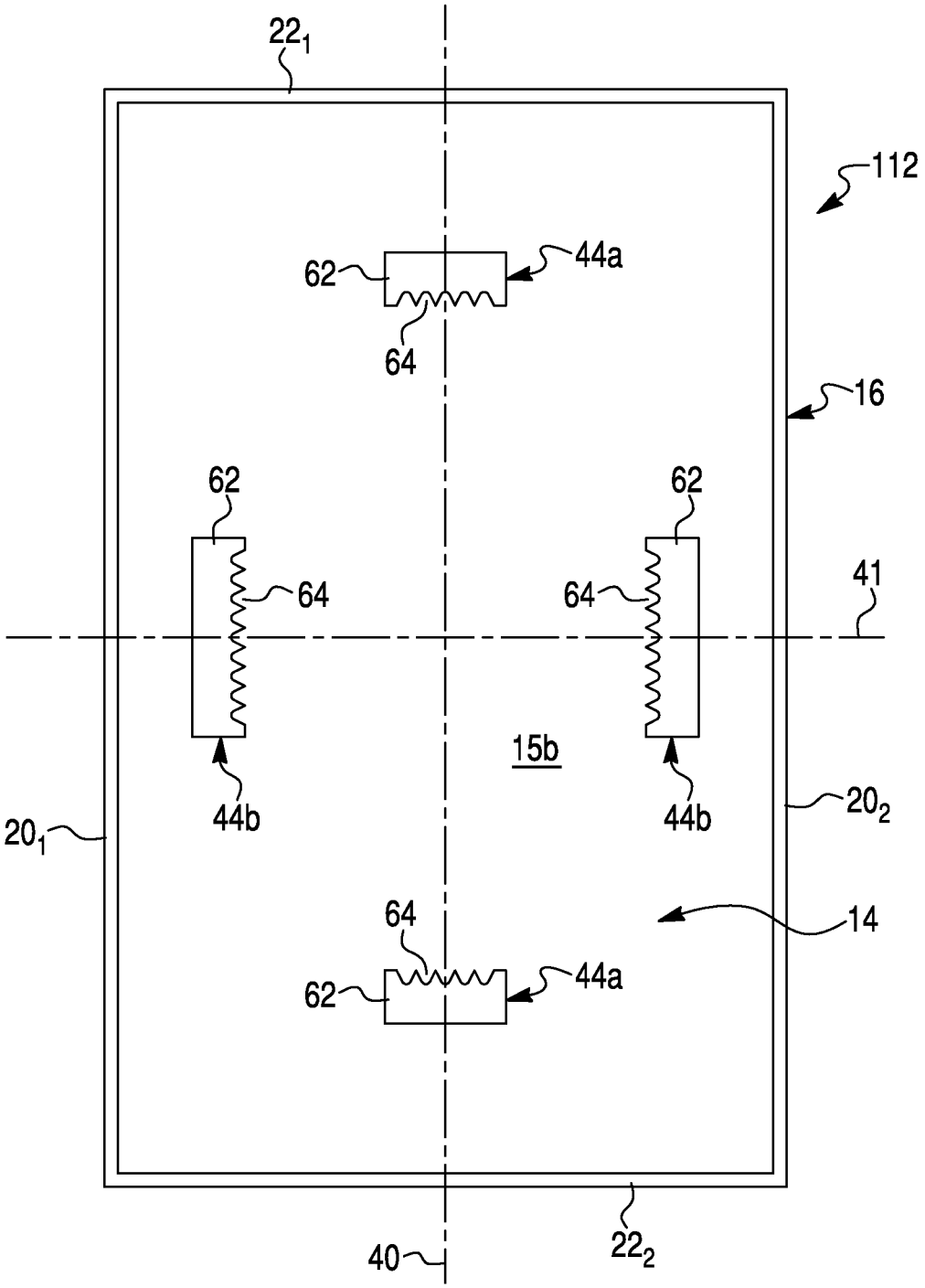
FIG. 19 is a rear view of the base member according to the second exemplary embodiment of the present invention.
Figure 20:
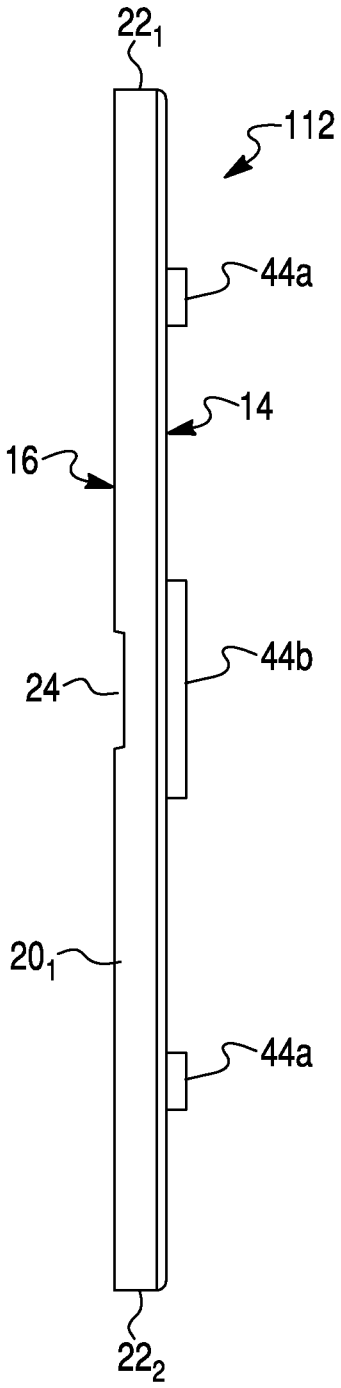
FIG. 20 is a side view of the base member according to the second exemplary embodiment of the present invention.

As shown in FIGS. 14 and 15, both the album cover 102 and the LP phonograph record 104 are displayed within the display case assembly 110 so that the LP record 104 is displayed in a position partially inserted behind the album cover 102 and partially exposed for viewing through a transparent cover panel 42 on the background of the background mat 66. In order to place the album cover 102 and the LP phonograph record 104 into the display case assembly 110, the long and short clamping strips 46, 48 are detached from the shallow tray 12 and the cover panel 42 is removed from the wall member 16 of the shallow tray 112. Then, the LP phonograph record 104 is inserted into the open top 117 of the shallow tray 112 and the central opening in the record 104 is positioned over the background mat 66 and the record mounting pin 38. The mounting pin 38 is located from the end wall $\mathbf{22}_1$ a distance substantially equal to one-half the spacing between the side walls $\mathbf{20}_1$ and $\mathbf{20}_2$ so that more than one-half and preferably most of a record label 105 is visible through the transparent cover panel 42 of the display case assembly 110. Next, the album cover 102 is positioned between the side flanges $\mathbf{20}_1$ and $\mathbf{20}_2$ widthwise and lengthwise between the tabs 133 and the lower end flange $\mathbf{22}_2$ of the shallow tray 112 and the cover panel 42 is placed on the ledge 26 on top of the album cover 102. Finally, the shallow tray 112 and the cover panel 42 are fastened together by the clamping strips 46, 48 due to the resiliency of the material employed, with the result that the album cover 102 and the phonograph record 104 are displayed, enclosed in between them. The clamping strips 46, 48 extend along the perimeter of the bottom panel 14 of the shallow tray 112.

Therefore, the present invention provides novel display case assembly for simultaneously displaying a phonograph record cover and phonograph record, and allows displaying an LP or 45 rpm record in all four directions (360 degrees). Moreover, clamping strips and matting technique allow a consumer to fully customize the display case assembly, since it can be disassembled (taken apart) in seconds and snap black, gold or silver clamping strips on it, and could be offered with a background mat in 12 or more different colors, all of which the consumer can buy and then change in seconds.

The foregoing description of the exemplary embodiment(s) of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A display case assembly for simultaneously displaying a phonograph record cover and phonograph record, comprising:

a base member in the form of an open top shallow tray having a planar bottom panel, a wall member defining said shallow tray and a pair of opposite tabs inwardly extending from said wall member so as to face each other, said bottom panel having an inner surface and an outer surface opposite said inner surface, said wall member extending upwardly from said inner surface of said bottom panel at an edge thereof along a perimeter of said bottom panel;

a record mounting post formed on and projecting from said inner surface of said bottom panel for mounting the phonograph record on said bottom panel adjacent said wall member, said mounting post being dimensioned to project through a central hole in the phonograph record to locate the phonograph record in said display case;

a generally planar cover panel mounted on and within said wall member of said base member, said cover panel made of a transparent material and dimensioned to overlay and cover an open top of said base member; and an edge trim member clamping together said cover panel and said base member at said edge of said bottom panel along said perimeter of said bottom panel;

said shallow tray being dimensioned to receive the record cover to display therein between said wall member and said mounting post.

2. The display case assembly according to claim 1, wherein said wall member is provided with an inwardly projecting ledge; and wherein said cover panel is mounted on and supported by said ledge of said wall member.

3. The display case assembly according to claim 2, further comprising a support flange member spaced from said wall member and extending upwardly from said inner surface of said bottom panel within a perimeter of said wall member.

4. The display case assembly according to claim 1, wherein said bottom panel of said base member is made of a generally rigid transparent material.

5. The display case according to claim 1, wherein said bottom panel has a generally rectangular shape; and wherein said wall member comprises two opposite sidewalls and two opposite end walls; and wherein said sidewalls and said end walls extend upwardly from said inner surface of said bottom panel at opposite side edges and opposite end edges thereof, respectively.

6. The display case assembly according to claim 5, wherein said tabs inwardly extend from said opposite sidewalls so as to face each other; and wherein a distance between said tabs and one of said end walls is such as to receive the record cover between said tabs and said one of said end walls.

7. The display case assembly according to claim 6, wherein said distance between said tabs and said one of said end walls is substantially equal to but slightly greater than the dimension of the record cover.

8. The display case assembly according to claim 6, wherein said record mounting post is formed adjacent one of said end walls.

9. The display case assembly according to claim 5, wherein said edge trim member comprises two substantially identical long trim strips extending longitudinally along said sidewalls and two short trim strips extending longitudinally along said end walls.

10. The display case assembly according to claim 9, wherein said transparent material is a generally rigid transparent synthetic resin material.

11. The display case assembly according to claim 1, wherein both said cover panel and said base member are formed of a generally rigid transparent material.

12. The display case assembly according to claim 1, wherein said wall member is formed with at least one notch configured to facilitate installation and removal of the phonograph record cover in said base member.

13. A display case assembly for simultaneously displaying a phonograph record cover and phonograph record, comprising:

a base member in the form of an open top shallow tray having a planar bottom panel and a wall member defining said shallow tray, said bottom panel having an inner surface and an outer surface opposite said inner surface, said wall member extending upwardly from said inner surface of said bottom panel at an edge thereof along a perimeter of said bottom panel;

a record mounting post formed on and projecting from said inner surface of said bottom panel for mounting the phonograph record on said bottom panel adjacent said wall member, said mounting post being dimensioned to project through a central hole in the phonograph record to locate the phonograph record in said display case;

a generally planar cover panel mounted on said wall member of said base member, said cover panel made of a transparent material and dimensioned to overlay and cover an open top of said base member;

an edge trim member clamping together said cover panel and said base member at said edge of said bottom panel along said perimeter of said bottom panel; and a support flange member spaced from said wall member and extending upwardly from said inner surface of said bottom panel within a perimeter of said wall member;

said shallow tray being dimensioned to receive the record cover to display therein between said wall member and said mounting post;

said wall member provided with an inwardly projecting ledge;

said cover panel mounted on and supported by said ledge of said wall member;

a height of said ledge being substantially equal to a height of said support flange member.

14. The display case assembly according to claim 13, wherein said base member further includes a pair of opposite tabs inwardly extending from said support flange member so as to face each other.

15. A display case assembly for simultaneously displaying a phonograph record cover and phonograph record, comprising:

a base member in the form of an open top shallow tray having a planar bottom panel and a wall member defining said shallow tray, said bottom panel having an inner surface and an outer surface opposite said inner surface, said wall member extending upwardly from said inner surface of said bottom panel at an edge thereof along a perimeter of said bottom panel;

a record mounting post formed on and projecting from said inner surface of said bottom panel for mounting the phonograph record on said bottom panel adjacent said wall member, said mounting post being dimensioned to project through a central hole in the phonograph record to locate the phonograph record in said display case;

a generally planar cover panel mounted on said wall member of said base member, said cover panel made of a transparent material and dimensioned to overlay and cover an open top of said base member; and an edge trim member clamping together said cover panel and said base member at said edge of said bottom panel along said perimeter of said bottom panel;

said shallow tray being dimensioned to receive the record cover to display therein between said wall member and said mounting post;

said bottom panel having a generally rectangular shape;

said wall member comprising two opposite sidewalls and two opposite end walls;

said sidewalls and said end walls extending upwardly from said inner surface of said bottom panel at opposite side edges and opposite end edges thereof, respectively;

said base member further including a pair of opposite tabs inwardly extending from said opposite sidewalls so as to face each other;

a distance between said tabs and one of said end walls is such as to receive the record cover between said tabs and said one of said end walls;

each of said sidewalls and each of said end walls provided with an inwardly projecting ledge;

said cover panel mounted on and supported by said ledge of said wall member.

16. The display case assembly according to claim 15, wherein said mounting post and said tabs have a height above said inner surface of said bottom panel substantially equal to but no greater than a height of said ledge.

17. A display case assembly for simultaneously displaying a phonograph record cover and phonograph record, comprising:

a base member in the form of an open top shallow tray having a planar bottom panel and a wall member defining said shallow tray, said bottom panel having an inner surface and an outer surface opposite said inner surface, said wall member extending upwardly from said inner surface of said bottom panel at an edge thereof along a perimeter of said bottom panel;

a support flange member spaced from said wall member and extending upwardly from said inner surface of said bottom panel within a perimeter of said wall member;

a record mounting post formed on and projecting from said inner surface of said bottom panel for mounting the phonograph record on said bottom panel adjacent said wall member, said mounting post being dimensioned to project through a central hole in the phonograph record to locate the phonograph record in said display case;

a generally planar cover panel mounted on said wall member of said base member, said cover panel made of a transparent material and dimensioned to overlay and cover an open top of said base member; and an edge trim member clamping together said cover panel and said base member at said edge of said bottom panel along said perimeter of said bottom panel;

said shallow tray being dimensioned to receive the record cover to display therein between said wall member and said mounting post;

said bottom panel having a generally rectangular shape;

said wall member comprising two opposite sidewalls and two opposite end walls;

said sidewalls and said end walls extending upwardly from said inner surface of said bottom panel at opposite side edges and opposite end edges thereof, respectively;

said support flange member including two opposite side flanges each extending along one of said sidewalls, and two opposite end flanges each extending along one of said end walls;

each of said sidewalls and each of said end walls provided with an inwardly projecting ledge; said cover panel mounted on and supported by said ledge of said wall member.

18. The display case assembly according to claim 17, wherein said base member further includes a pair of opposite tabs inwardly extending from said opposite side flanges so as to face each other; and wherein a distance between said tabs and one of said end flanges is such as to receive the record cover between said tabs and said one of said end flanges.

19. The display case assembly according to claim 18, wherein a height of said ledge substantially equals to a height of said side flanges and said end flanges of said support flange member, and said tabs.

20. The display case assembly according to claim 19, wherein said mounting post has a height above said inner surface of said bottom panel substantially equal to but no greater than a height of said support flange member.

* * * * *